US009703217B1

(12) United States Patent
Morales-Tirado

(10) Patent No.: US 9,703,217 B1
(45) Date of Patent: Jul. 11, 2017

(54) TONER COMPOSITIONS FOR MAGNETIC INK CHARACTER RECOGNITION

(71) Applicant: XEROX CORPORATION, Norwalk, CT (US)

(72) Inventor: Juan A. Morales-Tirado, Henrietta, NY (US)

(73) Assignee: XEROX CORPORATION, Norwalk, CT (US)

( * ) Notice: Subject to any disclaimer, the term of this patent is extended or adjusted under 35 U.S.C. 154(b) by 0 days.

(21) Appl. No.: 15/081,136

(22) Filed: Mar. 25, 2016

(51) Int. Cl.

| | |
|---|---|
| ***G03G 9/08*** | (2006.01) |
| ***G03G 9/083*** | (2006.01) |
| ***G03G 9/097*** | (2006.01) |
| ***G03G 9/087*** | (2006.01) |

(52) U.S. Cl.
CPC ..... *G03G 9/0833* (2013.01); *G03G 9/083* (2013.01); *G03G 9/0836* (2013.01); *G03G 9/08755* (2013.01); *G03G 9/097* (2013.01); *G03G 9/09708* (2013.01)

(58) Field of Classification Search
CPC ..... G03G 9/083; G03G 9/0836; G03G 9/097; G03G 9/09708; G03G 9/08755
USPC ..... 430/106.1
See application file for complete search history.

(56) References Cited

U.S. PATENT DOCUMENTS

| | | | | |
|---|---|---|---|---|
| 5,231,135 | A | 7/1993 | Machell et al. | |
| 5,621,022 | A | 4/1997 | Jaeger et al. | |
| 6,063,827 | A | 5/2000 | Sacripante et al. | |
| 6,221,137 | B1 | 4/2001 | King et al. | |
| 6,359,105 | B1 | 3/2002 | Ianni et al. | |
| 6,472,523 | B1 | 10/2002 | Banning et al. | |
| 6,476,219 | B1 | 11/2002 | Duff et al. | |
| 6,576,747 | B1 | 6/2003 | Carlini et al. | |
| 6,576,748 | B1 | 6/2003 | Carlini et al. | |
| 6,590,082 | B1 | 7/2003 | Banning et al. | |
| 6,646,111 | B1 | 11/2003 | Carlini et al. | |
| 6,663,703 | B1 | 12/2003 | Wu et al. | |
| 6,696,552 | B2 | 2/2004 | Mayo et al. | |
| 6,713,614 | B2 | 3/2004 | Carlini et al. | |
| 6,726,755 | B2 | 4/2004 | Titterington et al. | |
| 6,755,902 | B2 | 6/2004 | Banning et al. | |
| 6,821,327 | B2 | 11/2004 | Jaeger et al. | |
| 6,958,406 | B2 | 10/2005 | Banning et al. | |
| 7,053,227 | B2 | 5/2006 | Jaeger et al. | |
| 7,208,252 | B2 | 4/2007 | Grande et al. | |
| 7,381,831 | B1 | 6/2008 | Banning et al. | |
| 7,427,323 | B1 | 9/2008 | Birau et al. | |
| 2006/0166122 | A1* | 7/2006 | Patel | G03G 9/0804 430/110.2 |
| 2006/0222991 | A1 | 10/2006 | Sacripante et al. | |
| 2006/0269858 | A1* | 11/2006 | McDougall | G03G 9/0806 430/106.1 |

* cited by examiner

*Primary Examiner* — Mark A Chapman
(74) *Attorney, Agent, or Firm* — Pillsbury Winthrop Shaw Pittman LLP

(57) ABSTRACT

MICR toner compositions for use in offset lithography (or offset printing). Such MICR toner compositions exhibit desirable magnetic properties.

18 Claims, 13 Drawing Sheets

TONER COMPOSITIONS FOR MAGNETIC INK CHARACTER RECOGNITION

BACKGROUND

The present embodiments relate to toner compositions for magnetic ink character recognition ("MICR") and suitable for use in xerographic printing systems with offset lithographic print quality.

In the xerographic printing process, the image is generated after a series of steps which include charging of the surface of a photoreceptor, conversion of the computer data or original image into an optical or projected image, exposing the photoreceptor surface to the projected image, development of the toner particles on the photoreceptor by applying an electric field to the toner particles, transferring the toner particles from the photoreceptor to the media, and heating the toner particles so that they fuse together and permanently adhere to the media.

The magnetic toners used for printing may contain, for example, magnetic particles, such as magnetite in a fluid medium, and a magnetic coating of ferric oxide, chromium dioxide, or similar materials dispersed in a vehicle including binders and plasticizers.

Toners having magnetic ink character recognition ("MICR") capabilities should contain magnetic particles having a high level of magnetic saturation (such as from 10 to 25). Magnetic saturation is the highest degree of magnetization that a material can achieve after exposure to a magnetic field. When characters printed using a toner having a sufficiently high magnetic saturation are exposed to a magnetic field prior to passing through the MICR scanner, the magnetic particles produce a measurable signal, also called waveform, that can vary in proportion to the amount of material deposited on the document being generated, the extent of magnetic saturation, and the sharpness of the MICR characters.

In order to compete effectively with offset printing, or for high quality color applications or for special effects, some xerographic devices add a fifth xerographic station to enable gamut extension via the addition of a fifth color. At any given time, the xerographic printing machine runs CMYK toners plus a fifth color in the fifth station, depending on the color space where the gamut extension is desired or a specific special effect. The area of gamut expansion depends on the color installed in the fifth station. A fifth color is any spot color or clear ink used in addition to the four color CMYK mix (Cyan, Magenta, Yellow and Black).

MICR toners can be more challenging to develop in some development subsystems. This is because the inclusion of the magnetite in the MICR toner makes the toner particle heavier and reduces the toner electrostatic charge as compared to the conventional toners. A heavier particle with lower electrostatic charge challenges Hybrid Scavengeless Development ("HSD"). This toner development method relies on powder cloud development. A powder cloud is formed between a toner donor roll and the surface of the photoreceptor due to an AC bias generated by a set of wires between the photoreceptor and the donor roll. In an HSD systems, all colors are developed to the photoreceptor via powder cloud, one color at a time, The charge of the toner particles and the electrostatic set points of the system are set so that not toner particles laying on the photoreceptor surface transfer back to a donor roll as the virtual image on the photoreceptor moves from one color station to another. Hence the term scavengeless development.

To increase the capability and applications of and HSD system with fifth station, there is a need to develop a fifth color toner having MICR capabilities to run in the fifth xerographic station.

SUMMARY

The present disclosure provide a toner composition comprising a toner particle comprising a crosslinked polyester resin; a magnetite; and a surface additive applied to a surface of the toner particle.

In certain embodiments, the disclosure provide a toner composition comprising a toner particle further comprising a crosslinked polyester resin; a magnetite; and a surface additive applied to a surface of the toner particle, wherein the surface additive comprises a negative charging silica, a positive charging silica and a metal oxide; further wherein the toner has a magnetic retentivity of from 5 to 10 emu/gram, a coercivity of from about 430 Oe to about 530 Oe, and a magnetization of from 10 emu/g to 15 emu/g.

In certain embodiments, the disclosure provides a toner composition comprising: a toner particle further comprising a crosslinked resin, wherein the crosslinked polyester has a degree of crosslinking of from about 19% to about 49%; a magnetite in an amount of from about 10% to about 25% by weight of the toner; a colorant; and a surface additive applied to a surface of the toner particle, wherein the surface additive comprises a negative charging silica, a positive charging silica and a metal oxide; further wherein the toner has a magnetic retentivity of from 5 emu/gram to 15 emu/gram, a coercivity of from about 450 Oe to about 550 Oe, and a magnetic saturation of from 10 emu/g to 20 emu/g.

BRIEF DESCRIPTION OF DRAWINGS

Various embodiments of the present disclosure will be described herein below with reference to the figures wherein.

DETAILED DESCRIPTION

Figure 1:
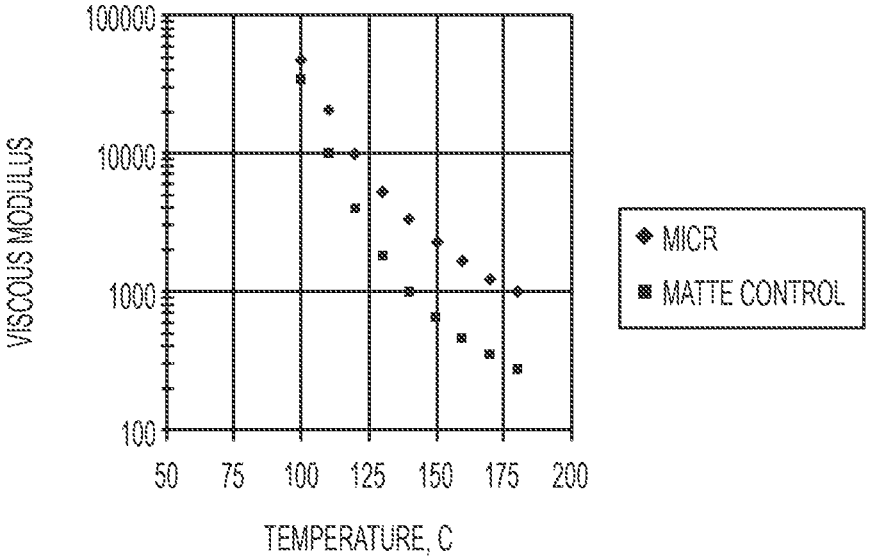
FIG. 1 is a graph of viscous modulus of a MICR toner according to an embodiment of the present invention and a black matte control toner.

The present embodiments provide a toner having magnetic ink character recognition capabilities (also refers as "MICR toner") suitable for use in xerographic systems providing offset lithography print quality.

The MICR toners composition of the present embodiments includes a magnetite. Magnetites selected for the toner can be octahedral, spheroidal or acicular. Exemplary magnetites include iron oxides, such as Iron II oxide, Iron III oxide, FeO, $FeO_3$, $Fe_2O_3$, $Fe_3O_4$, and mixtures thereof. Both untreated and surface treated magnetites can be used in the toners. Surface treated magnetites can contain coatings, such as phosphate, titanium or silane coupling agent components. Specific examples of untreated and treated magnetites that can be selected include Magnox Corporation MAGNOX B-350® and B-353®, ISK magnetics MO-4232®, HX-3204®, MCX-2096®, MO-7029® and MO-4431®, or Toda Kogyo Corporation MTA-740® or MTA-230®. Examples of surface treated magnetites include MO-7029® and MO-4431®. The amount of magnetite presented in the MICR toner may be from about 10% to about 25%, from about 15% to about 20%, or from about 15% to about 25% based on the total weight of the toner, so as to impart a magnetic retentivity of from about 5 to about 15 emu/gram, from about 5 to about 10 emu/gram, or from about 10 to about 15 emu/gram of the toner when measured at a 1,000 Oersted field strength in a vibration magnetometer such as VSM LakeShore Model 7300 or comparable device. The term "retentivity" used herein, is defined as the retentivity of the MICR toner, which is a measure of a material's ability to retain a certain amount of residual magnetic field when the magnetizing force is removed after achieving saturation. In embodiments, the MICR toners of the present embodiments have a coercivity of from about 450 Oe to about 550 Oe, or from about 430 Oe to about 530 Oe, or from about 490 Oe to about 510 Oe. The term "coercivity" refers to the intensity of the applied magnetic field required to reduce the magnetization of that material to zero after the magnetization of the sample has been driven to saturation. In embodiments, the toners of the present embodiments have a magnetic saturation (vs. 1 KOe) of from 10 emu/g to 20 emu/g, from 10 emu/g to 15 emu/g, or from 15 emu/g to 20 emu/g. The term "magnetic saturation" used herein, is defined as a measure of the highest level of magnetization that a material can achieve after exposure to a magnetic field.

The MICR toner composition of the present embodiments is not an emulsion aggregation toner. In certain embodiments, the MICR toner does not contain any non-crosslinked polyester resin (i.e., linear polyester resin).

Crosslinking Resin

The MICR toner composition of the present embodiments includes a crosslinked polyester resin. The crosslinked polyester has a degree of crosslinking of from about 19% to about 49%, from about 25% to about 40%, or from about 30% to about 35%.

The crosslinked polyester may be prepared by crosslinking an unsaturated amorphous polyester resin or crosslinking an unsaturated crystalline polyester resin. Linear or branched unsaturated polyesters can be converted into a highly crosslinked polyester by reactive extrusion. Linear or branched unsaturated polyesters may include both saturated and unsaturated diacids (or anhydrides) and dihydric alcohols (glycols or diols). The resulting unsaturated polyesters can be reactive (for example, crosslinkable) on two fronts: (i) unsaturation sites (double bonds) along the polyester chain, and (ii) functional groups, such as, carboxyl, hydroxy and similar groups amenable to acid-base reaction. Unsaturated polyester resins may be prepared by melt polycondensation or other polymerization processes using diacids and/or anhydrides and diols. Illustrative examples of unsaturated polyesters may include any of various polyesters, such as SPAR™ (Dixie Chemicals), BECKOSOL™ (Reichhold Inc), ARAKOTE™ (Ciba-Geigy Corporation), HETRON™ (Ashland Chemical), PARAPLEX™ (Rohm & Hass), POLYLITE™ (Reichhold Inc), PLASTHALL™ (Rohm & Hass), CYGAL™ (American Cyanamide), ARMCO™ (Armco Composites), ARPOL™ (Ashland Chemical), CELANEX™ (Celanese Eng), RYNITE™ (DuPont), STYPOL™ (Freeman Chemical Corporation), a linear unsaturated poly(propoxylated bisphenol A co-fumarate) polyester, XP777 (Reichhold Inc.), mixtures thereof and the like. The resins may also be functionalized, such as, carboxylated, sulfonated or the like, such as, sodio sulfonated.

The crosslinked resin may be prepared by (1) melting the linear or branched unsaturated polyester in a melt mixing device; (2) initiating cross-linking of the polymer melt, preferably with a chemical crosslinking initiator and increasing reaction temperature; (3) keeping the polymer melt in the melt mixing device for a sufficient residence time that partial cross-linking of the linear or branched resin may be achieved; (4) providing sufficiently high shear during the cross-linking reaction to keep the gel particles formed and broken down during shearing and mixing and well distributed in the polymer melt; (5) optionally devolatizing the polymer melt to remove any effluent volatiles; and (6) optionally adding additional linear or branched resin after the crosslinking in order to achieve the desired level of gel content in the end resin. As used herein, the term "gel" refers to the crosslinked domains within the polymer. Chemical initiators such as, for example, organic peroxides or azo-compounds may be used for making the crosslinked resin for the invention. In one embodiment, the initiator is 1,1-di(t-butyl peroxy)-3,3,5-trimethylcyclohexane.

Crystalline Resins

In embodiments, the crystalline resin may be a polyester resin formed by reacting a diol with a diacid in the presence of an optional catalyst. For forming a crystalline polyester, suitable organic diols include aliphatic diols with from about 2 to about 36 carbon atoms, such as 1,2-ethanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,12-dodecanediol and the like; alkali sulfo-aliphatic diols such as sodio 2-sulfo-1,2-ethanediol, lithio 2-sulfo-1,2-ethanediol, potassio 2-sulfo-1,2-ethanediol, sodio 2-sulfo-1,3-propanediol, lithio 2-sulfo-1,3-propanediol, potassio 2-sulfo-1,3-propanediol, mixtures thereof, and the like. The aliphatic diol may be, for example, selected in an amount of from about 40 to about 60 mole % (although amounts outside of those ranges may be used).

Examples of organic diacids or diesters including vinyl diacids or vinyl diesters selected for the preparation of the crystalline resins include oxalic acid, succinic acid, glutaric acid, adipic acid, suberic acid, azelaic acid, sebacic acid, fumaric acid, dimethyl fumarate, dimethyl itaconate, cis-1,4-diacetoxy-2-butene, diethyl fumarate, diethyl maleate, phthalic acid, isophthalic acid, terephthalic acid, naphthalene-2,6-dicarboxylic acid, naphthalene-2,7-dicarboxylic acid, cyclohexane dicarboxylic acid, malonic acid, mesaconic acid, and a diester or anhydride thereof. The organic diacid may be selected in an amount of, for example, in embodiments from about 40 to about 60 mole %.

Specific unsaturated crystalline polyester resins include poly(ethylene-adipate), poly(propylene-adipate), poly(butylene-adipate), poly(pentylene-adipate), poly(hexylene-adipate), poly(octylene-adipate), poly(ethylene-succinate), poly(propylene-succinate), poly(butylene-succinate), poly(pentylene-succinate), poly(hexylene-succinate), poly(octylene-succinate), poly(ethylene-sebacate), poly(propylene-sebacate), poly(butylene-sebacate), poly(pentylene-sebacate), poly(hexylene-sebacate), poly(octylene-sebacate), poly(decylene-sebacate), poly(decylene-decanoate), poly(ethylene-decanoate), poly(ethylene dodecanoate), poly(nonylene-sebacate), poly(nonylene-decanoate), copoly(ethylene-fumarate)-copoly(ethylene-sebacate), copoly(ethylene-fumarate)-copoly(ethylene-decanoate), copoly(ethylene-fumarate)-copoly(ethylene-dodecanoate) and so on. Examples of polyamides include poly(ethylene-adipamide), poly(propylene-adipamide), poly(butylenes-adipamide), poly(pentylene-adipamide), poly(hexylene-adipamide), poly(octylene-adipamide), poly(ethylene-succinimide), and poly(propylene-sebecamide). Examples of polyimides include poly(ethylene-adipimide), poly(propylene-adipimide), poly(butylene-adipimide), poly(pentylene-adipimide), poly(hexylene-adipimide), poly(octylene-adipimide), poly(ethylene-succinimide), poly(propylene-succinimide), and poly(butylene-succinimide).

Suitable crystalline resins include those disclosed in U.S. Publ. No. 2006/0222991, the disclosure of which is hereby incorporated by reference in entirety. In embodiments, a suitable crystalline resin may be composed of ethylene glycol and a mixture of dodecanedioic acid and fumaric acid co-monomers.

The crystalline resin may possess various melting points of, for example, from about 30° C. to about 120° C., in embodiments, from about 50° C. to about 90° C. The crystalline resin may have a number average molecular weight (Mn) as measured by gel permeation chromatography (GPC) of, for example, from about 1,000 to about 50,000, in embodiments, from about 2,000 to about 25,000, and a weight average molecular weight (Mw) of, for example, from about 2,000 to about 100,000, in embodiments, from about 3,000 to about 80,000, as determined by GPC. The molecular weight distribution (Mw/Mn) of the crystalline resin may be, for example, from about 2 to about 6, in embodiments, from about 3 to about 4. The crystalline polyester resins may have an acid value of less than about 1 meq KOH/g, from about 0.5 to about 0.65 meq KOH/g, in embodiments, from about 0.65 to about 0.75 meq KOH/g, from about 0.75 to about 0.8 meq KOH/g.

Amorphous Resins

Examples of diacid or diesters selected for the preparation of amorphous polyesters include dicarboxylic acids or diesters selected from the group consisting of terephthalic acid, phthalic acid, isophthalic acid, fumaric acid, maleic acid, itaconic acid, succinic acid, succinic anhydride, dodecylsuccinic acid, dodecylsuccinic anhydride, glutaric acid, glutaric anhydride, adipic acid, pimelic acid, suberic acid, azelaic acid, dodecanediacid, dimethyl terephthalate, diethyl terephthalate, dimethylisophthalate, diethylisophthalate, dimethylphthalate, phthalic anhydride, diethylphthalate, dimethylsuccinate, dimethylfumarate, dimethylmaleate, dimethylglutarate, dimethyladipate, dimethyl dodecylsuccinate, and mixtures thereof. The organic diacid or diester is selected, for example, from about 45 to about 52 mole % of the resin.

Examples of diols utilized in generating the amorphous polyester include 1,2-propanediol, 1,3-propanediol, 1,2-butanediol, 1,3-butanediol, 1,4-butanediol, pentanediol, hexanediol, 2,2-dimethylpropanediol, 2,2,3-trimethylhexanediol, heptanediol, dodecanediol, bis(hyroxyethyl)-bisphenol A, bis(2-hyroxypropyl)-bisphenol A, 1,4-cyclohexanedimethanol, 1,3-cyclohexanedimethanol, xylenedimethanol, cyclohexanediol, diethylene glycol, bis(2-hydroxyethyl) oxide, dipropylene glycol, dibutylene, 1,2-ethanediol, 1,5-pentanediol, 1,6-hexanediol, 1,7-heptanediol, 1,8-octanediol, 1,9-nonanediol, 1,10-decanediol, 1,12-dodecanediol, and the like; alkali sulfo-aliphatic diols, such as, sodio 2-sulfo-1,2-ethanediol, lithio 2-sulfo-1,2-ethanediol, potassio 2-sulfo-1,2-ethanediol, sodio 2-sulfo-1,3-propanediol, lithio 2-sulfo-1,3-propanediol, potassio 2-sulfo-1,3-propanediol, mixtures thereof, and the like, and mixtures thereof. The amount of organic diol selected may vary, and more specifically, is, for example, from about 45 to about 52 mole % of the resin.

Alkali sulfonated difunctional monomer examples, wherein the alkali is lithium, sodium, or potassium, include dimethyl-5-sulfo-isophthalate, dialkyl-5-sulfo-isophthalate-4-sulfo-1,8-naphthalic anhydride, 4-sulfo-phthalic acid, 4-sulfophenyl-3,5-dicarbomethoxybenzene, 6-sulfo-2-naphthyl-3,5-dicarbomethoxybenzene, sulfo-terephthalic acid, dimethyl-sulfo-terephthalate, dialkyl-sulfo-terephthalate, sulfo-ethanediol, 2-sulfo-propanediol, 2-sulfo-butanediol, 3-sulfo-pentanediol, 2-sulfo-hexanediol, 3-sulfo-2-methylpentanediol, N,N-bis(2-hydroxyethyl)-2-aminoethane sulfonate, 2-sulfo-3,3-dimethylpent-anediol, sulfo-p-hydroxybenzoic acid, mixtures thereto, and the like. Effective difunctional monomer amounts of, for example, from about 0.1 to about 2 wt % of the resin may be selected.

Exemplary unsaturated amorphous polyester resins include, but are not limited to, propoxylated bisphenol A fumarate resin, poly(propoxylated bisphenol co-fumarate), poly(ethoxylated bisphenol co-fumarate), poly(butyloxylated bisphenol co-fumarate), poly(co-propoxylated bisphenol co-ethoxylated bisphenol co-fumarate), poly(1,2-propylene fumarate), poly(propoxylated bisphenol co-maleate), poly(ethoxylated bisphenol co-maleate), poly(butyloxylated bisphenol co-maleate), poly(co-propoxylated bisphenol co-ethoxylated bisphenol co-maleate), poly(1,2-propylene maleate), poly(propoxylated bisphenol co-itaconate), poly(ethoxylated bisphenol co-itaconate), poly(butyloxylated bisphenol co-itaconate), poly(co-propoxylated bisphenol co-ethoxylated bisphenol co-itaconate), poly(1,2-propylene itaconate), a copoly(propoxylated bisphenol A co-fumarate)-copoly(propoxylated bisphenol A co-terephthalate), a terpoly (propoxylated bisphenol A co-fumarate)-terpoly(propoxylated bisphenol A co-terephthalate)-terpoly-(propoxylated bisphenol A co-dodecylsuccinate), and combinations thereof.

In one embodiment, the crosslinked resin is prepared from an unsaturated poly(propoxylated bisphenol A co-fumarate) polyester resin. Examples of such resins and processes for their production include those disclosed in U.S. Pat. No. 6,063,827, the disclosure of which is hereby incorporated by reference in entirety.

In embodiments, a suitable amorphous resin utilized in a toner of the present disclosure may be a low molecular weight amorphous resin, sometimes referred to, in embodiments, as an oligomer, having an Mw of from about 500 daltons to about 10,000 daltons, in embodiments, from about 1000 daltons to about 5000 daltons, in embodiments, from about 1500 daltons to about 4000 daltons. The amorphous resin may possess a Tg of from about 58.5° C. to about 66° C., in embodiments, from about 60° C. to about 62° C. The low molecular weight amorphous resin may possess a softening point of from about 105° C. to about 118° C., in embodiments, from about 107° C. to about 109° C. The amorphous polyester resins may have an acid value of from about 8 to about 20 meq KOH/g, in embodiments, from about 10 to about 16 meq KOH/g, in embodiments, from about 11 to about 15 meq KOH/g.

In other embodiments, an amorphous resin utilized in forming a toner of the present disclosure may be a high molecular weight amorphous resin. As used herein, the high molecular weight amorphous polyester resin may have, for example, an Mn, as measured by GPC of, for example, from about 1,000 to about 10,000, in embodiments, from about 2,000 to about 9,000, in embodiments, from about 3,000 to about 8,000, in embodiments from about 6,000 to about 7,000. The Mw of the resin can be greater than 45,000, for example, from about 45,000 to about 150,000, in embodiments, from about 50,000 to about 100,000, in embodiments, from about 63,000 to about 94,000, in embodiments, from about 68,000 to about 85,000, as determined by GPC. The polydispersity index (PD), equivalent to the molecular weight distribution, is above about 4, such as, for example, in embodiments, from about 4 to about 20, in embodiments, from about 5 to about 10, in embodiments, from about 6 to about 8, as measured by GPC. The high molecular weight amorphous polyester resins, which are available from a number of sources, may possess various melting points of, for example, from about 30° C. to about 140° C., in embodiments, from about 75° C. to about 130° C., in embodiments, from about 100° C. to about 125° C., in embodiments, from about 115° C. to about 124° C. High molecular weight amorphous resins may possess a Tg of from about 53° C. to about 58° C., in embodiments, from about 54.5° C. to about 57° C.

In further embodiments, the combined amorphous resins may have a melt viscosity of from about 10 to about 1,000,000 Pa*S at about 130° C., in embodiments, from about 50 to about 100,000 Pa*S.

Catalyst

Polycondensation catalysts which may be utilized in forming either the crystalline or amorphous polyesters include tetraalkyl titanates, dialkyltin oxides, such as, dibutyltin oxide, tetraalkyltins, such as, dibutyltin dilaurate, and dialkyltin oxide hydroxides, such as, butyltin oxide hydroxide, aluminum alkoxides, alkyl zinc, dialkyl zinc, zinc oxide, stannous oxide, or combinations thereof. Such catalysts may be utilized in amounts of, for example, from about 0.01 mole % to about 5 mole %, based on the starting diacid or diester used to generate the polyester resin.

Colorant

The MICR toner compositions described herein also include a colorant. Any desired or effective colorant can be employed in the MICR toner compositions, including dyes, pigments, mixtures thereof. Any dye or pigment may be chosen, provided that it is capable of being dispersed or dissolved in the MICR toner and is compatible with the other MICR toner components.

Any conventional toner colorant materials, such as Color Index (C.I.) Solvent Dyes, Disperse Dyes, modified Acid and Direct Dyes, Basic Dyes, Sulphur Dyes, Vat Dyes, fluorescent dyes and the like. Examples of suitable dyes include NEOZAPON® Red 492 (BASF); ORASOL® Red G (Pylam Products); Direct Brilliant Pink B (Oriental Giant Dyes); Direct Red 3BL (Classic Dyestuffs); SUPRANOL® Brilliant Red 3BW (Bayer AG); Lemon Yellow 6G (United Chemie); Light Fast Yellow 3G (Shaanxi); Aizen Spilon Yellow C-GNH (Hodogaya Chemical); Bemachrome Yellow GD Sub (Classic Dyestuffs); CARTASOL® Brilliant Yellow 4GF (Clariant); Cibanone Yellow 2G (Classic Dyestuffs); ORASOL® Black RLI (BASF); ORASOL® Black CN (Pylam Products); Savinyl Black RLSN (Clariant); Pyrazol Black BG (Clariant); MORFAST® Black 101 (Rohm & Haas); Diaazol Black RN (ICI); THERMOPLAST® Blue 670 (BASF); ORASOL® Blue GN (Pylam Products); Savinyl Blue GLS (Clariant); LUXOL® Fast Blue MBSN (Pylam Products); Sevron Blue SGMF (Classic Dyestuffs); BASACID® Blue 750 (BASF); KEYPLAST® Blue (Keystone Aniline Corporation); NEOZAPON® Black X51 (BASF); Classic Solvent Black 7 (Classic Dyestuffs); SUDAN® Blue 670 (C.I. 61554) (BASF); SUDAN® Yellow 146 (C.I. 12700) (BASF); SUDAN® Red 462 (C.I. 26050) (BASF); C.I. Disperse Yellow 238; Neptune Red Base NB543 (BASF, C.I. Solvent Red 49); Neopen Blue FF-4012 (BASF); Fatsol Black BR (C.I. Solvent Black 35) (Chemische Fabriek Triade BV); Morton Morplas Magenta 36 (C.I. Solvent Red 172); metal phthalocyanine colorants such as those disclosed in U.S. Pat. No. 6,221,137, the disclosure of which is totally incorporated herein by reference, and the like. Polymeric dyes can also be used, such as those disclosed in, for example, U.S. Pat. No. 5,621,022 and U.S. Pat. No. 5,231,135, the disclosures of each of which are herein entirely incorporated herein by reference, and commercially available from, for example, Milliken & Company as Milliken Ink Yellow 869, Milliken Ink Blue 92, Milliken Ink Red 357, Milliken Ink Yellow 1800, Milliken Ink Black 8915-67, uncut Reactint Orange X-38, uncut Reactint Blue X-17, Solvent Yellow 162, Acid Red 52, Solvent Blue 44, and uncut Reactint Violet X-80.

Pigments are also suitable colorants for the MICR toners. Examples of suitable pigments include PALIOGEN® Violet 5100 (BASF); PALIOGEN® Violet 5890 (BASF); HELIOGEN® Green L8730 (BASF); LITHOL® Scarlet D3700 (BASE); SUNFAST® Blue 15:4 (Sun Chemical); HOSTAPERM® Blue B2G-D (Clariant); HOSTAPERM® Blue B4G (Clariant); Permanent Red P-F7RK; HOSTAPERM® Violet BL (Clariant); LITHOL® Scarlet 4440 (BASF); Bon Red C (Dominion Color Company); ORACET® Pink RF (BASF); PALIOGEN® Red 3871 K (BASF); SUNFAST® Blue 15:3 (Sun Chemical); PALIOGEN® Red 3340 (BASF); SUNFAST® Carbazole Violet 23 (Sun Chemical); LITHOL® Fast Scarlet L4300 (BASF); SUNBRITE® Yellow 17 (Sun Chemical); HELIOGEN® Blue L6900, L7020 (BASF); SUNBRITE® Yellow 74 (Sun Chemical); SPECTRA PAC C Orange 16 (Sun Chemical); HELIOGEN® Blue K6902, K6910 (BASF); SUNFAST® Magenta 122 (Sun Chemical); HELIOGEN® Blue D6840, D7080 (BASF); SUDAN® Blue OS (BASF); NEOPEN Blue FF4012 (BASF); PV Fast Blue B2GO1 (Clariant); IRGALITE Blue GLO (BASF); PALIOGEN® Blue 6470 (BASF); SUDAN® Orange G (Aldrich); SUDAN® Orange 220 (BASF); PALIOGEN® Orange 3040 (BASF); PALIOGEN® Yellow 152, 1560 (BASF); LITHOL® Fast Yellow 0991 K (BASF); PALIOTOL Yellow 1840 (BASF); NOVOPERM Yellow FGL (Clariant); Ink Jet Yellow 4G VP2532 (Clariant); Toner Yellow HG (Clariant); Lumogen Yellow D0790 (BASF); Suco-Yellow L1250 (BASF); Suco-Yellow D1355 (BASF); Suco Fast Yellow D1355, D1351 (BASF); HOSTAPERM Pink E 02 (Clariant); Hansa Brilliant Yellow 5GX03 (Clariant); Permanent Yellow GRL 02 (Clariant); Permanent Rubine L6B 05 (Clariant); FANAL Pink D4830 (BASF); CINQUASIA® Magenta (DU PONT); PALIOGEN® Black L0084 (BASF); Pigment Black K801 (BASF); and carbon blacks such as REGAL 330™ (Cabot), Nipex 150 (Evonik) Carbon Black 5250 and Carbon Black 5750 (Columbia Chemical), and the like, as well as mixtures thereof.

Pigment dispersions in the MICR toner may be stabilized by synergists and dispersants. Generally, suitable pigments may be organic materials or inorganic. Magnetic material-based pigments are also suitable. Magnetic pigments include magnetic nanoparticles, such as for example, ferromagnetic nanoparticles.

Also suitable are the colorants disclosed in U.S. Pat. No. 6,472,523, U.S. Pat. No. 6,726,755, U.S. Pat. No. 6,476,219, U.S. Pat. No. 6,576,747, U.S. Pat. No. 6,713,614, U.S. Pat. No. 6,663,703, U.S. Pat. No. 6,755,902, U.S. Pat. No. 6,590,082, U.S. Pat. No. 6,696,552, U.S. Pat. No. 6,576,748, U.S. Pat. No. 6,646,111, U.S. Pat. No. 6,673,139, U.S. Pat. No. 6,958,406, U.S. Pat. No. 6,821,327, U.S. Pat. No. 7,053,227, U.S. Pat. No. 7,381,831 and U.S. Pat. No. 7,427,323, the disclosures of each of which are incorporated herein by reference in their entirety.

In embodiments, the colorant is carbon black such as Regal 330. The colorant may be present in the MICR toner in any desired or effective amount to obtain the desired color or hue such as, for example, from about 2 percent to about 4 percent, or from about 2.5 to about 3.5 percent, or from about 3 to about 4 percent by weight of a colorant.

Compatibilizer

Compatibilizers that can be used in the MICR toner composition are functionalized polymers such as epoxy or acid functionalized polymers. In embodiments, the epoxy or acid functionalized polymers are epoxy or acid functionalized olefine polymers. Examples of epoxy functionalized olefine polymers are copolymers of ethylene-glycidyl methacrylate or ethylene-glycidyl acrylate or terpolymers of ethylene-glycidyl methacrylate-acrylate or glycidyl methacrylate functionalized polyethylene or glycidyl methacrylate functionalized acrylate terpolymers. Examples of acid functionalized olefine polymers are maleic anhydride functionalized olefine polymers such as maleic anhydride functionalized polypropylene or maleic anhydride functionalized polyethylene. In embodiment, a copolymer of ethylene and glycidyl methacrylate is used as compatibilizer, such as LOTADER® AX8840 available from Arkema. The compatibilizer may be presented in the MICR toner in an amount of from about 2 percent to about 7 percent, or from about 2 to about 6 percent, or from about 4 to about 7 percent by weight of the MICR toner.

Surface Additives

The toner composition of the present embodiments may include one or more surface additives. The surface additives may be coated onto the surface of the toner particles, in embodiments, by blending them in a high intensity mixer. The surface additives may provide a total surface area coverage of from about 125% to about 200%, from about 140% to about 180%, or from about 150% to about 200% of the toner particle surface. The toner composition of the present embodiment may include from about 4% to about 7.0%, from about 4.5% to about 6.5%, or from about 5.0% to about 6.0% of surface additive based on the total weight on the toner.

The surface additives may include silica, titania and stearates. The charging and flow characteristics of a toner are influenced by the selection of surface additives and concentration of such in the toner. The concentration of surface additives and their size and shape control the arrangement of these on the toner particle surface. In embodiments, the silica includes one negatively charge coated silica. By negatively charging is meant that the additive is negatively charging relative to the toner surface measured by determining the toner triboelectric charge with and without the additive.

An example of the negative charging silica include NA50HS obtained from DeGussa/Nippon Aerosil Corporation, which is a fumed silica coated with a mixture of hexamethyldisilazane and aminopropyltriethoxysilane (having approximately 30 nanometers of primary particle size and about 350 nanometers of aggregate size).

The negative charging silica may be present in an amount from about 3.0% to about 5.0%, from about 3.5% to about 5.0%, from about 3.9% to about 4.3%, by weight of the surface additives.

The surface additives may also include a titania. The titania may be present in an amount from about 0.0.75% to about 1.25%, from about 0.80% to about 1.2%, from about 0.9% to about 1.1%, by weight of the surface additives. A suitable titania for use herein is, for example, SMT5103 available from Tayca Corp., a titania having a size of about 25 to about 55 nm treated with decylsilane.

The weight ratio of the negative charging silica to the titania is from about 2.0:1 to about 6.7:1, from about 3.0:1 to about 5.0:1, or from about 4.0:1 to about 6.7:1.

The surface additives may also include a lubricant and conductivity aid, for example a metal salt of a fatty acid such as, e.g., zinc stearate, calcium stearate. A suitable example includes Zinc Stearate L from Ferro Corp., or calcium stearate from Ferro Corp. Such a conductivity aid may be present in an amount from about 0.10% to about 1.00% by weight of the toner.

In another preferred embodiment, the toner and/or surface additive also includes a conductivity aid, for example a metal salt of a fatty acid such as, e.g., zinc stearate. A suitable example includes Zinc Stearate L from Ferro Corp. Such a conductivity aid may be present in an amount from about 0.10% to about 1.00% by weight of the toner.

The toner compositions of the present embodiments can be prepared by mixing, for example, melt mixing, and heating resin particles in a toner extrusion device, such as the ZSK25 available from Werner Pfleiderer, and removing the formed toner composition from the device. Subsequent to cooling, the toner composition is subjected to grinding utilizing, for example, a Sturtevant micronizer, reference U.S. Pat. No. 5,716,751, the disclosure of which is totally incorporated herein by reference. Subsequently, the toner compositions can be classified utilizing, for example, a Donaldson Model B classifier for the purpose of removing fines, that is, the particles are accompanied by very low levels of fine particles of the same material. For example, the level of fine particles is in the range of from about 10% to about 15% by weight of the toner. After removing the excess fines content, the magnetic toner may have a mean particle size of from about 8 microns to about 12 microns, from about 8.5 microns to about 10.5 microns, or about 9 microns to about abut 10 microns as measured by a Multisizer III. The GSD refers to the upper geometric standard deviation (GSD) by volume (coarse level) for (D84/D50) and can be from about 1.10 to about 1.30, or from about 1.15 to about 1.25, or from about 1.18 to about 1.21. The geometric standard deviation (GSD) by number (fines level) for (D50/D16) can be from about 1.10 to about 1.30, or from about 1.15 to about 1.25, or from about 1.22 to about 1.24. The particle diameters at which a cumulative percentage of 50% of the total toner particles are attained are defined as volume D50, and the particle diameters at which a cumulative percentage of 84% are attained are defined as volume D84. These aforementioned volume average particle size distribution indexes GSDv can be expressed by using D50 and D84 in cumulative distribution, wherein the volume average particle size distribution index GSDv is expressed as (volume D84/volume D50). These aforementioned number average particle size distribution indexes GSDn can be expressed by using D50 and D16 in cumulative distribution, wherein the number average particle size distribution index GSDn is expressed as (number D50/number D16). The closer to 1.0 that the GSD value is, the less size dispersion there is among the particles. The aforementioned GSD value for the toner particles indicates that the toner particles are made to have a narrow particle size distribution. The particle diameters are determined by a Multisizer III.

Thereafter, the surface additive mixture and other additives are added by the blending thereof with the toner obtained. The term "particle size," as used herein, or the term "size" as employed herein in reference to the term "particles," means volume weighted diameter as measured by conventional diameter measuring devices, such as a Multisizer III, sold by Coulter, Inc. Mean volume weighted diameter is the sum of the mass of each particle times the diameter of a spherical particle of equal mass and density, divided by total particle mass.

The size distribution and additive formulation of the MICR toner is such that it enables the toner to be operated in a system providing offset lithography at a very low mass target while still providing sufficient coverage of the substrate. In this context, the mass target refers to concentration of toner particles that are developed or laid on the substrate (i.e. paper or other) per unit area of substrate. The size distribution and additive formulation of the toner is such that it enables the system to operate at a mass target of 0.3 to 0.4 mg of toner per square centimeter of substrate. The rheology of the toner of the present embodiments is also designed to reduce the risk of toner offset to the fuser with the fuser roll used in the system.

Viscoelastic properties that influence the extent of fuser roll contamination with toner are typically described by the property ratio tan δ. Tan δ is a ratio of the storage modulus G' (elastic modulus) and the loss modulus G" (viscous modulus). The elastic modulus is related to the elasticity of a toner and the viscous modulus is related to the plasticity of a toner. To reduce the probability or extent of fuser roll contamination, it is important to adjust a ratio of elasticity to plasticity while maintaining a desired elasticity. The toner of the present embodiments exhibit an Elastic Modulus of from about 1680 dyn/cm$^2$ to about 2520 dyn/cm$^2$, from about 1890 dyn/cm$^2$ to about 2300 dyn/cm$^2$, or about 2100 dyn/cm$^2$. The toner of the present embodiments exhibit an Viscous Modulus of from about 250 dyn/cm$^2$ to about 385 dyn/cm$^2$, from about 290 dyn/cm$^2$ to about 350 dyn/cm$^2$, or about 320 dyn/cm$^2$. Both the Viscous and Elastic Modulus are measured at 140° C. at a frequency of 40 rad/sec.

The MICR toner of the present disclosure demonstrates a tribo value in B Zone from about 20 to about 35 μC/g, for example, from about 22 to about 30 μC/g or from about 24 and 28 μC/g. The MICR toner of the present disclosure demonstrates a signal strength >110%, for example from about 110% to about 140%, or from about 115% to about 130%. The signal strength is a measure if the magnetic waveform from each MICR character as it passes by a reader. The peak value of the induced waveform are referenced to a nominal or desired value and the ratio of the two is the resulting signal strength. The MICR toner of the present disclosure demonstrates a character recognition between 1.5 and 2.5, for example, from about 1.6 to about 2.1 or from about 1.7 to about 2.0.

The following Examples are being submitted to illustrate embodiments of the present disclosure. These Examples are intended to be illustrative only and are not intended to limit the scope of the present disclosure. Also, parts and percentages are by weight unless otherwise indicated. As used herein, "room temperature" refers to a temperature of from about 20° C. to about 25° C.

EXAMPLES

Example 1

Preparation of MICR Toner Particles in Accordance to Embodiments Herein

Example 1A—Preparation of Parent Particles

About 57% of a crosslinked polyester resin (a propoxylated bisphenol A fumarate resin, Resapol from Reichold), about 20% of a magnetite such as B353 Magnox, about 5.2% of a Polyethylene wax such as PW2000, about 4.7% of a Polypropylene wax such as Viscol 660P, about 4.7% of a compatibilizer such as Lotader AX-8840, and about 2.8% of a colorant (e.g., R330 Carbon Black), were melt mixed and extruded in a ZSK-25 extruder. The crosslinked resin was prepared according to the method outlined in U.S. Pat. No. 6,359,105, incorporated here by reference in its entirety.

The resulting extrudate of linear and crosslinked resin was pulverized in a 200 AFG fluid bed jet mill. During the pulverization process, about 0.3% TS530 silica was added as a flow aid. The parent particle has a median particle size of about 9 microns, a mean size of about 9.5 μm after removing the excess fines contents, i.e., with percent fines less than 5 μm or no more than 15% by number as measured by a. Multisizer III The toner particles were classified in a B18 Tandem Acucut system. The toner particle has an Elastic Modulus of around 4000 dyn/cm$^2$ and a Viscous Modulus of 1000 dyn/cm$^2$. The Viscous and Elastic Modulus are measured at 180° C. at a frequency of 40 rad/sec. (we can delete if you do not have these information).

Example 1B—Blending of Surface Additives to Parent Particles

The parent particles obtained above were blended in a 75L Henschel Vertical Mixer under a specific power level of around 228 W/lb and delivering a total specific energy of 15.2 Wh/lb. The power and energy levels were set with the impeller speed and blend time. The additive formulation selected based on the level of the additives is as follows:

| Additive | Additive % |
|---|---|
| NA50HS (Silica) | 3.99% |
| SMT5103 (Titania) | 0.87% |
| ZnSt-L | 0.50% |

The formulation leads to a total Surface Area Coverage of the particle from the surface additives or around 175% and a Surface Area Coverage Ratio of NA50HS Silica to SMT5103 Titania of around 10.2. Zinc Stearate at 0.5% is also added as a lubricant.

Example 2

Properties of the MICR Toner Particles

The viscous modulus, elastic modulus and tan delta of the MICR toner particles prepared in Example 1 were compared with a black matte control toner.

Xerox iGen 150 Black Matte Toner was used as the Matte Control toner (part number 6R1541).

FIG. 1 is a graph of the viscous modulus of a MICR toner according to an embodiment of the present invention and a black matte control toner. Referring to FIG. 1, the viscous moduli to the toners prepared according to Example 1 is higher across the temperature range used during the test. As expected, the viscous modulus decreases as the temperature increases.

Figure 2:
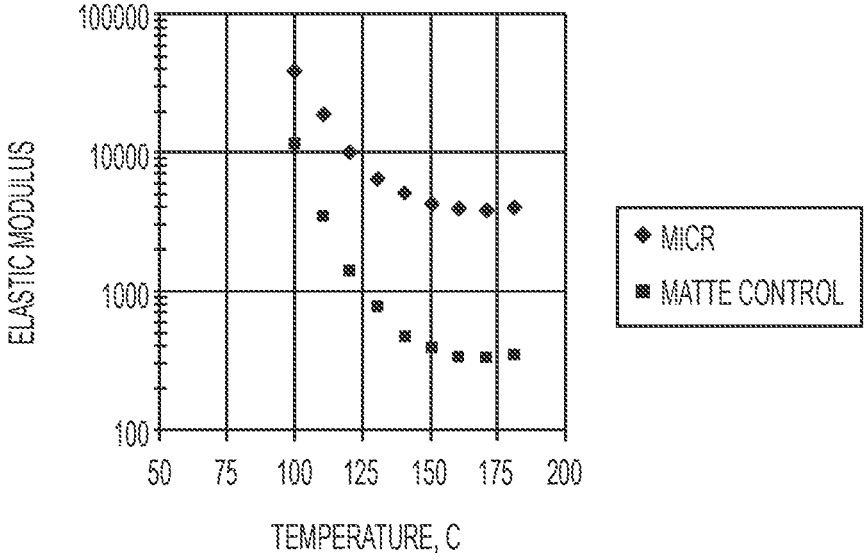
FIG. 2 is a graph of elastic modulus of a MICR toner according to an embodiment of the present invention and a black matte control toner.
Figure 3:
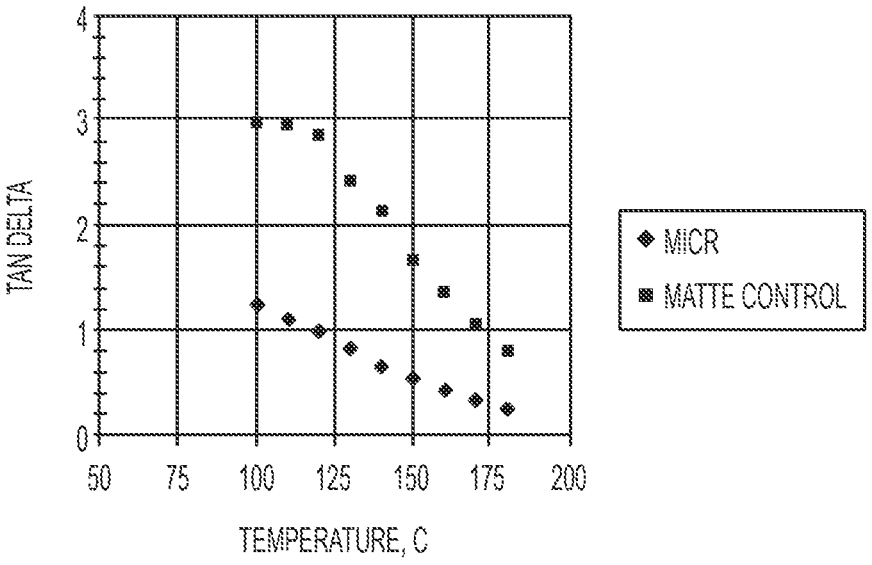
FIG. 3 is a graph of a tan delta of a MICR toner according to an embodiment of the present invention and a black matte control toner.
Figure 4A:
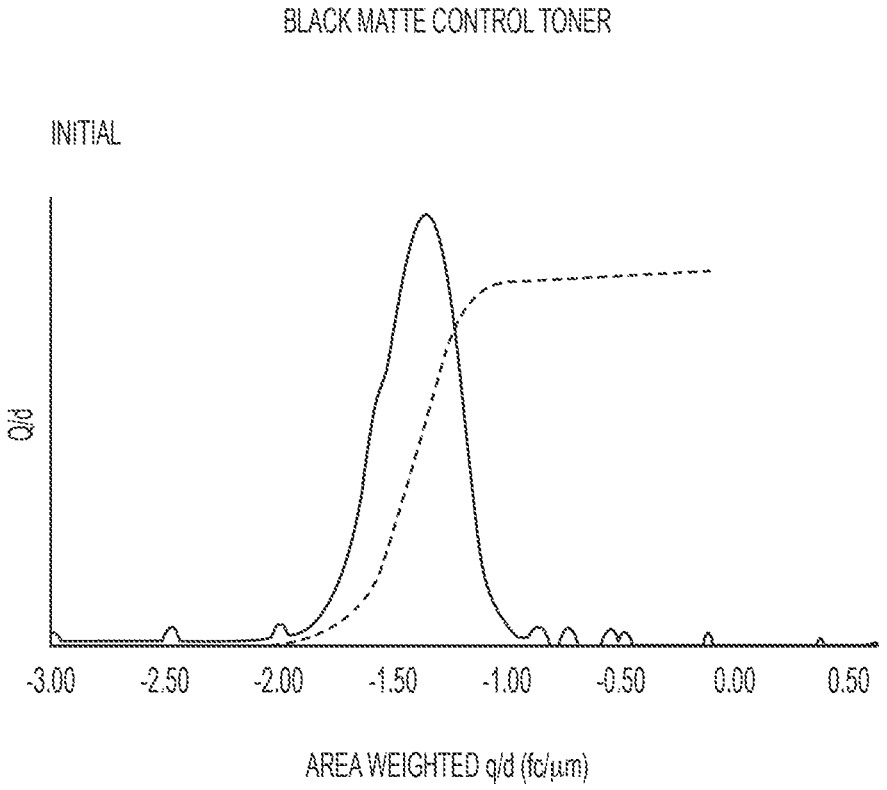
FIGS. 4A-H show the charge distributions of a black matte control toner at t=0 (FIG. 4A), 15 s (FIG. 4B), 30 s (FIG. 4C), and 60 s (FIG. 4D), and MICR toner according to an embodiment of the present invention at t=0 (FIG. 4E), 15 s (FIG. 4F), 30 s (FIG. 4G), and 60 s (FIG. 4H).
Figure 4B:
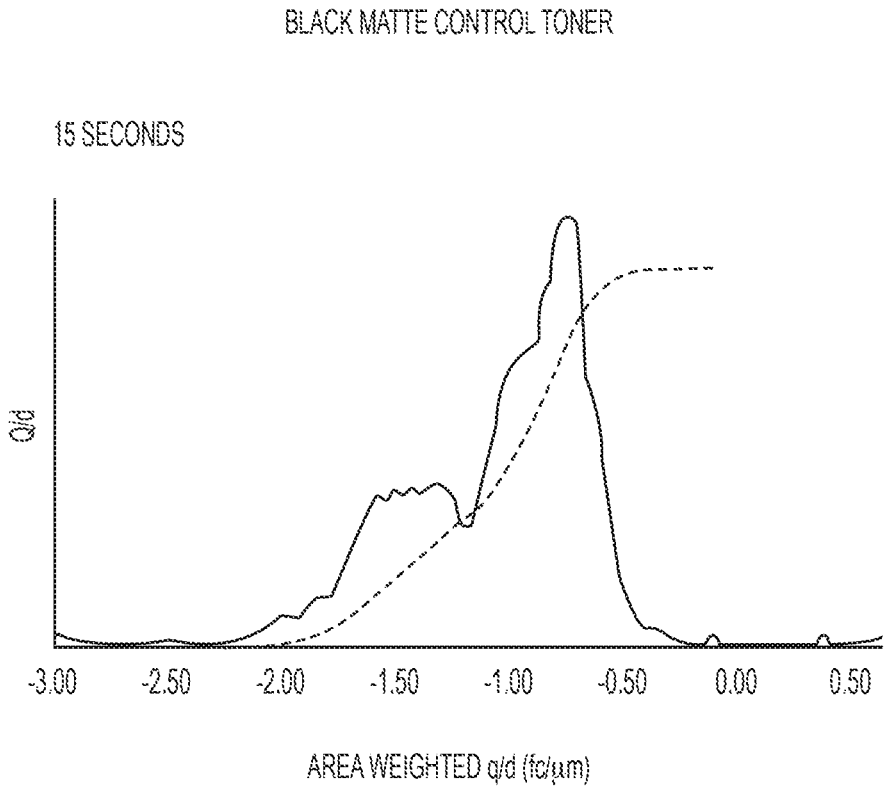
Figure 4C:
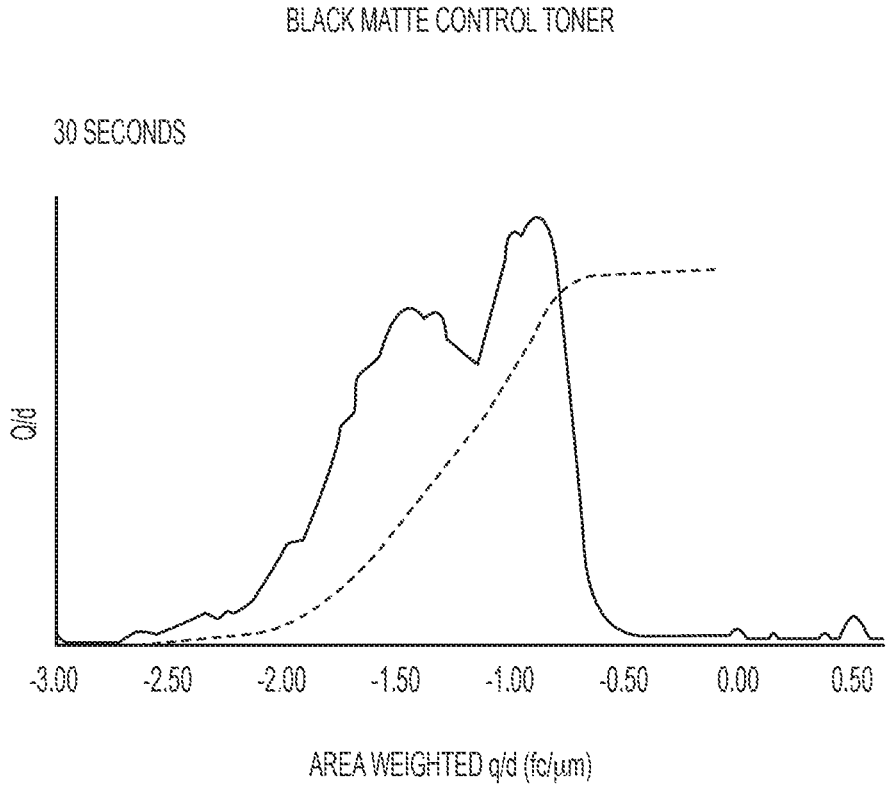
Figure 4D:
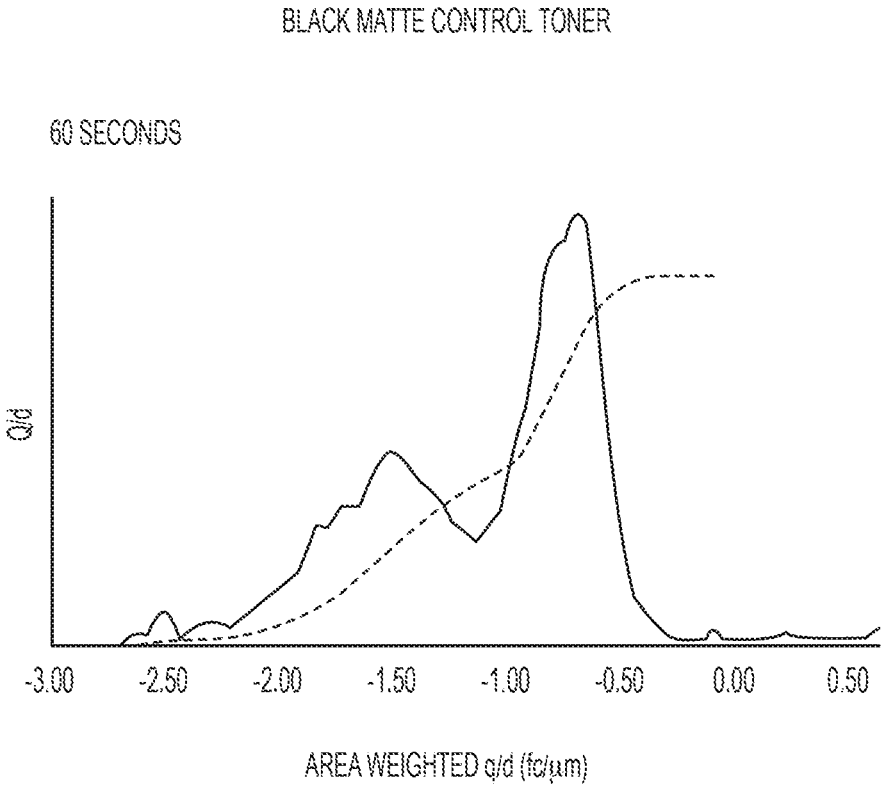
Figure 4E:
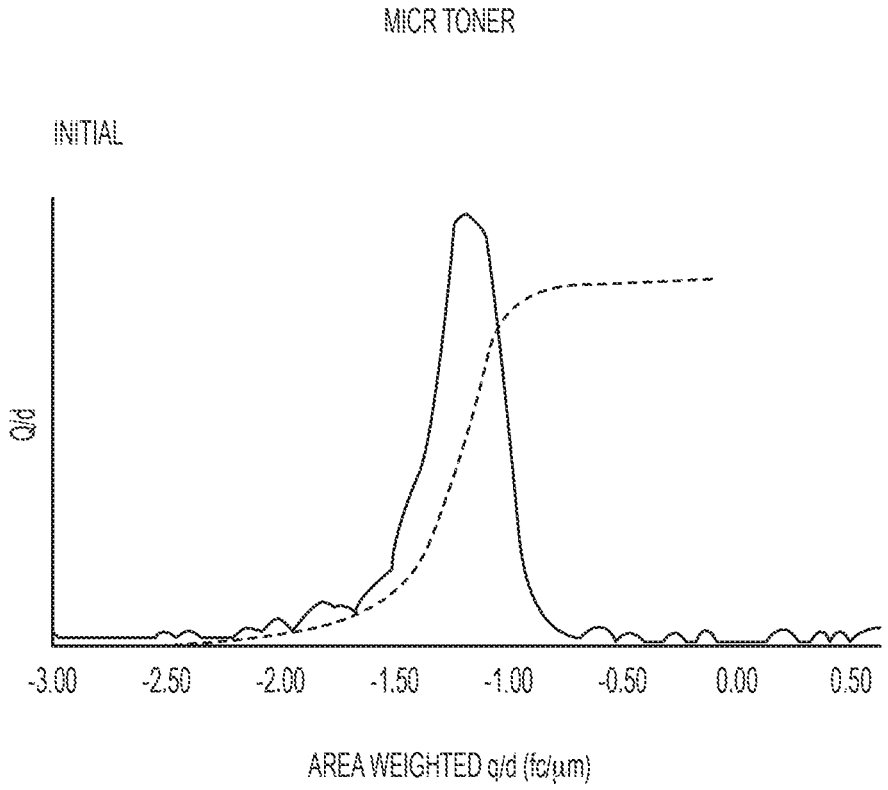
Figure 4F:
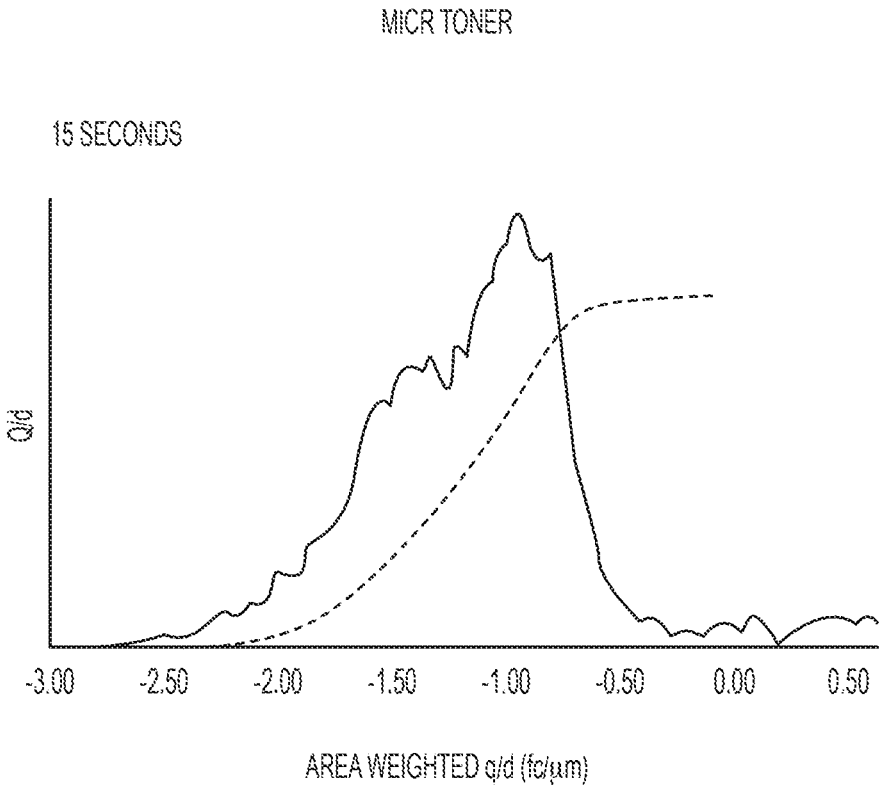
Figure 4G:
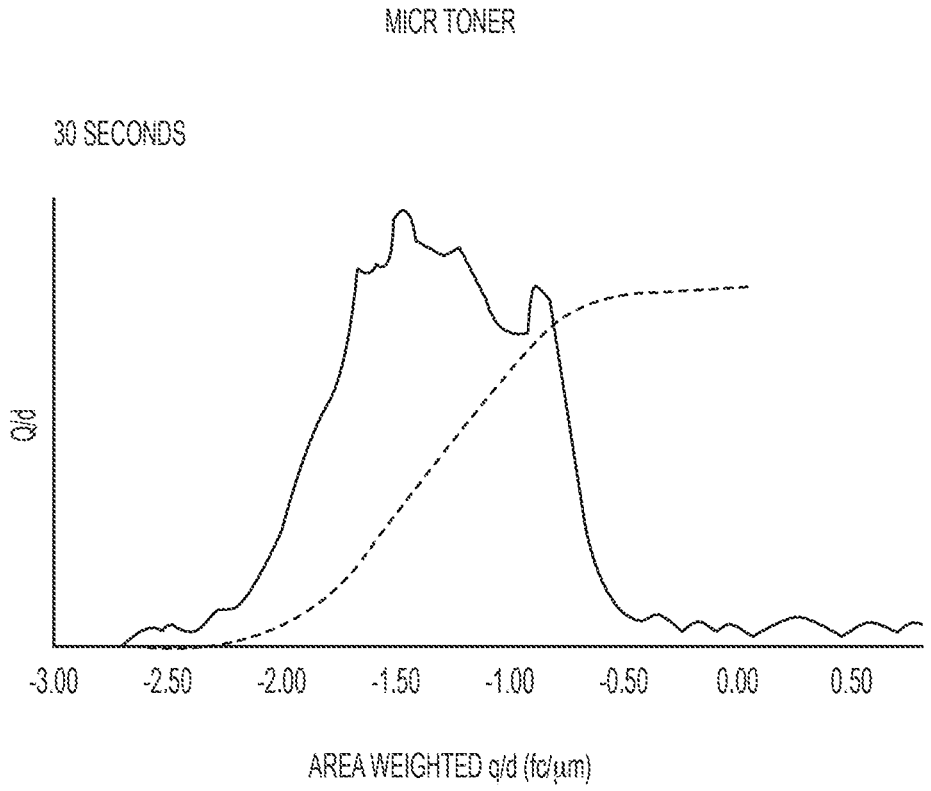
Figure 4H:
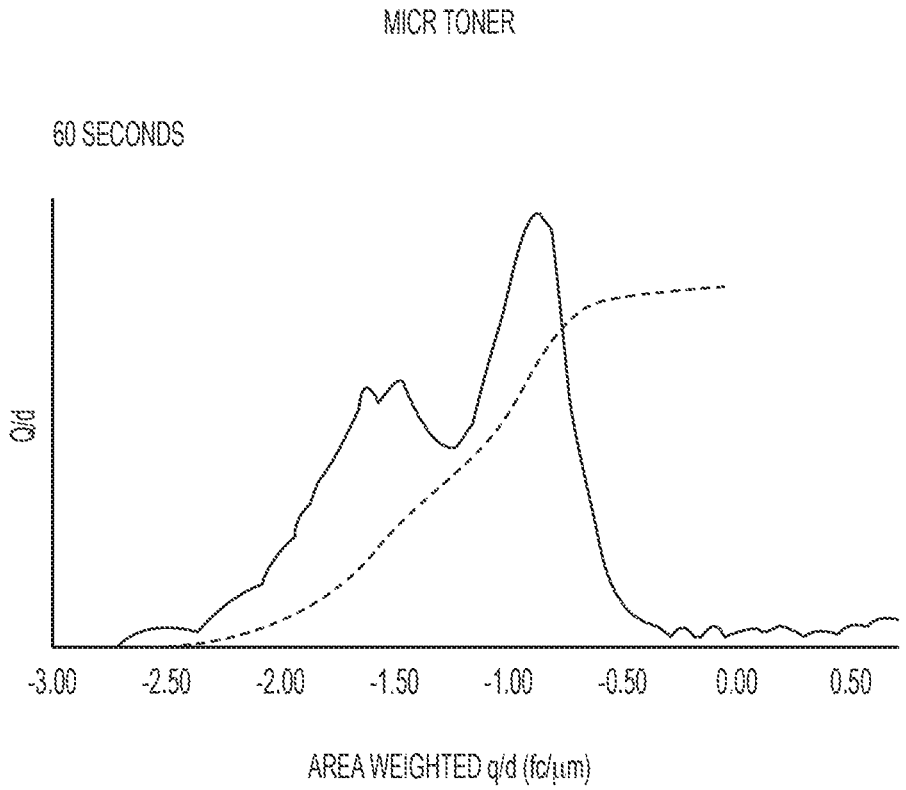

FIG. 2 is a graph of the elastic modulus of a MICR toner according to an embodiment of the present invention and a black matte control toner. Referring to FIG. 2, the elastic moduli to the toners prepared according to Example 1 is higher across the temperature range used during the test. The elastic modulus decreases as the temperature increases and reaches a stable state at a temperature of 150° C. FIG. 3 is a graph of a tan delta of a MICR toner according to an embodiment of the present invention and a black matte control toner. Referring to FIG. 3, the tan delta of the toners prepared according to Example 1 is lower across the temperature range used during the test. The moduli and tan delta data indicate that although the MICR toner according to an embodiment of the present invention is higher in viscosity and elasticity, it will result in a lower probability of contaminating the fuser roll in the fusing subsystem compared to the Matte Control toner.

Example 3

Triboelectric Charge:

The charging characteristics of the toners were assessed via Tribo (Q/m) and Charge Distribution (Q/d). The MICR toner of Example 1 and a black matte control toner were examined using an admix test.

Typically, the admix test is used in toner design to characterize the evolution of the charge distribution of a toner population when fresh toner is added to a toner population that has been aged in a development housing. In this experiment, the admix test was performed by combining the fresh toner and the aged toner in a jar. To perform the test, a set amount of toner and a set amount of carrier were placed in a glass jar. The amount of toner and carrier were set so that the toner was at a concentration that is representative of that in a typical development housing. Typical concentrations may be in the range of, for example, 4% to 8% by weight toner concentration. Once the toner and carrier were placed in a glass jar, they were mixed together by either placing the jar in a paint shaker or a roll mill. The mixing and agitation of the toner and carrier lead to triboelectric charging and changes in the surface morphology of both toner and carrier that can lead to changes in charge stability among others. For example, toner and carrier in a glass jar can be mixed in a paint shaker for 60 minutes or in a roll mill for 20 minutes. The frequency of oscillation of the paint shaker and rotational speed of the roll mill are also set. After the toner and carrier on the jar were mixed together, a sample of fresh toner was added. The fresh toner was typically added such that the toner concentration increases by 50% (e.g., if the initial toner concentration is 4% the fresh toner to be added such that the new toner concentration is 6%). Once the fresh toner was added, the jar was closed and placed back in either the paint shaker or roll mill. The jar was agitated for set amounts of time. Samples were taken after 15 seconds (i.e., t=15 s), 30 seconds, and 120 seconds of agitation. After each time interval, a sample of developer (toner and carrier mixture) was removed and a charge distribution of the toner was generated. This process allows understanding how the aged toner initially in the jar and the fresh toner interact with each other to form a toner population that has a uniform charge distribution. In the ideal case, a unimodal charge distribution is achieved. However, in some cases a bi-modal charge distribution is observed. A unimodal charge distribution is an indication that the aged and fresh toner can achieve similar charge quickly. A bi-modal charge distribution suggests that the toners have different charging characteristics resulting from the interaction of the aged toner against the carrier when agitated. A bi-modal charge distribution is not always an indication of a broken design.

FIG. 4 shows the charge distributions of the MICR toner and the black matte control toner at t=0, 15s, 30s, and 60s. The addition of magnetite to a toner formulation can, in some cases, affect the charge distribution. Comparing the charge distributions of the MICR toner to the distributions of the black matte toner shows that the MICR toner has similar charging behavior to the black matte toner when fresh toner is added to an aged developer. In both cases, the charge distributions become bimodal over time, which is an indication that the fresh toner will charge slightly faster than the toner in the aged developer. This is not an ideal scenario, but one that the printing system can tolerate since the two toners are behaving similarly.

The B-zone tribo of the MICR toner was determined and compared against that of the matte control toner. A 60 minute paint shake time track in B-zone was completed for the Example 1 MICR toner and black matte control toners, and the results are shown in FIGS. 5 and 6.

Figure 5:
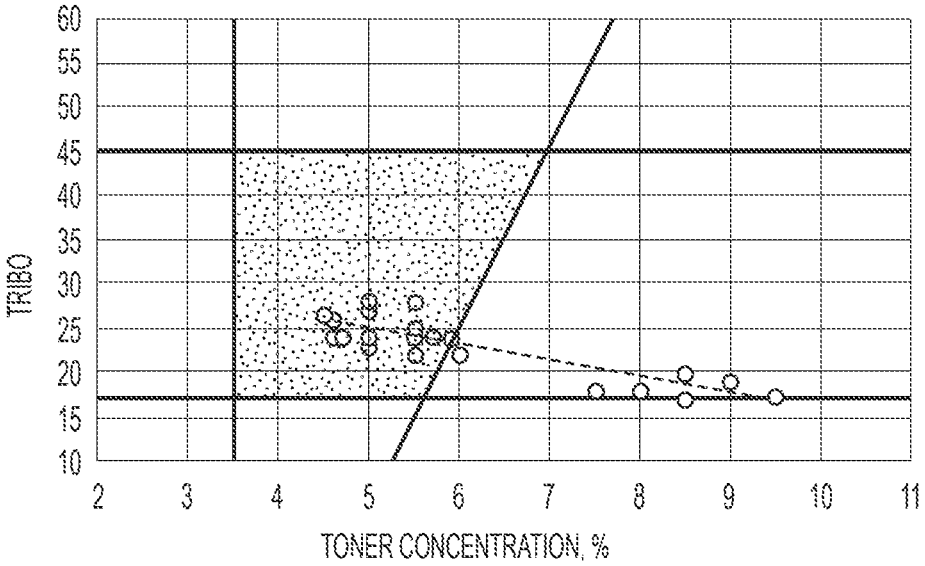
FIG. 5 is a graph showing measured B-zone triboelectric charge for a MICR toner according to an embodiment of the present disclosure and black matte control toner.
Figure 6:
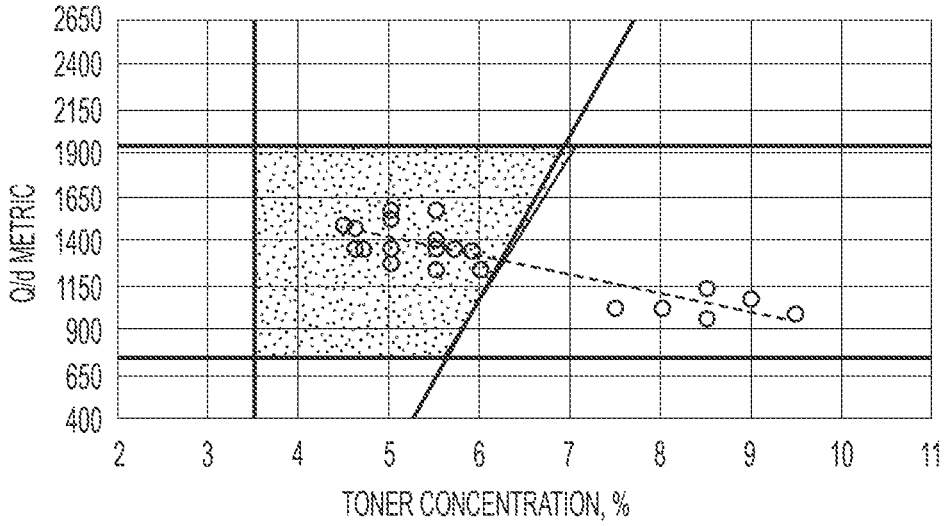
FIG. 6 shows the charging data of the MICR toner of Example 1 in the form of Q/d versus TC.

FIG. 5 shows tribo versus toner concentration (TC) of the MICR toner of Example 1 in B Zone when running the toner in the printing system. B-zone is a term used to indicate the type of environment when the relative humidity is around 50% and the temperature is around 70 degrees Celsius. FIG. 5 also shows where tribo falls relative to the system boundaries established with CMYK toners. The shaded area represents the desired operating space for TC and Tribo.

The tribo operating space can be converted to an operating space based on Q/d. This can be useful when comparing charging characteristics of toners with different size. Also, the Q/d distribution is more meaningful for failure modes such as background. Tribo (Q/m) and Q/d are related by $(Q/m)=(Q/d)*(6)*(1/d^2p\pi)$. FIG. 6 shows the charging data of the MICR toner of Example 1 in the form of Q/d versus TC. The data shows that in Q/d space the charge of the MICR toner falls well within the current system boundaries when the system operates within the TC boundaries.

While the description above refers to particular embodiments, it will be understood that many modifications may be made without departing from the spirit thereof. The accompanying claims are intended to cover such modifications as would fall within the true scope and spirit of embodiments herein.

The presently disclosed embodiments are, therefore, to be considered in all respects as illustrative and not restrictive, the scope of embodiments being indicated by the appended claims rather than the foregoing description. All changes that come within the meaning of and range of equivalency of the claims are intended to be embraced therein.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

All the patents and applications referred to herein are hereby specifically, and totally incorporated herein by reference in their entirety in the instant specification.

What is claimed is:

1. A MICR toner composition comprising:

a toner particle further comprising:

a crosslinked polyester resin;

a magnetite presented in the toner in an amount of from about 10% to about 25%; and a surface additive applied to a surface of the toner particle;

wherein the toner has a magnetic retentivity of from 5 emu/gram to 15 emu/gram.

2. The MICR toner of claim 1, wherein the toner is not an emulsion aggregation toner.

3. The MICR toner of claim 1, wherein the toner has a coercivity of from about 450 Oe to about 550 Oe.

4. The MICR toner of claim 1, wherein the toner has a magnetic saturation of from 10 emu/g to 20 emu/g.

5. The MICR toner of claim 1, wherein the magnetite comprises an iron oxide.

6. The MICR toner of claim 1, wherein the crosslinked polyester resin comprises an amorphous resin.

7. The MICR toner of claim 6, wherein the amorphous polyester resin is selected from the group consisting of propoxylated bisphenol A fumarate resin, poly(propoxylated bisphenol co-fumarate), poly(ethoxylated bisphenol co-fumarate), poly(butyloxylated bisphenol co-fumarate), poly (co-propoxylated bisphenol co-ethoxylated bisphenol cofumarate), poly(1,2-propylene fumarate), poly(propoxylated bisphenol co-maleate), poly(ethoxylated bisphenol co-maleate), poly(butyloxylated bisphenol co-maleate), poly(co-propoxylated bisphenol co-ethoxylated bisphenol co-maleate), poly(1,2-propylene maleate), poly(propoxylated bisphenol co-itaconate), poly(ethoxylated bisphenol co-itaconate), poly(butyloxylated bisphenol co-itaconate), poly(copropoxylated bisphenol co-ethoxylated bisphenol co-itaconate), poly(1,2-propylene itaconate), a copoly (propoxylated bisphenol A co-fumarate)-copoly(propoxylated bisphenol A co-terephthalate), a terpoly (propoxylated bisphenol A co-fumarate)-terpoly(propoxylated bisphenol A co-terephthalate)-terpoly-(propoxylated bisphenol A co-dodecylsuccinate), and combinations thereof.

8. The MICR toner of claim 7, wherein the amorphous polyester resin comprises propoxylated bisphenol A fumarate resin.

9. The MICR toner of claim 1, wherein the crosslinked resin prepared from an unsaturated poly(propoxylated bisphenol A co-fumarate) polyester resin.

10. The MICR toner of claim 1, wherein the crosslinked polyester has a degree of crosslinking of from about 19% to about 49%.

11. The MICR toner of claim 1, wherein the surface additive comprises silica, titania, and a stearate.

12. The MICR toner of claim 11, wherein the silica comprises a negative charging silica.

13. The MICR toner of claim 11, wherein the titania comprises titanium dioxide.

14. The MICR toner of claim 1 further comprising a colorant.

15. The MICR toner of claim 1 further comprising a compatibilizer.

16. The MICR toner of claim 1, wherein the toner particle has a mean size of from about 8 to about 12 microns.

17. A MICR toner composition comprising:

a toner particle further comprising:

a crosslinked polyester resin;

a magnetite presented in the toner in an amount of from about 15% to about 20%; and a surface additive applied to a surface of the toner particle, wherein the surface additive comprises a negative charging silica, a positive charging silica and a metal oxide;

further wherein the toner has a magnetic retentivity of from 5 to 10 emu/gram, a coercivity of from about 430 Oe to about 530 Oe, and a magnetization of from 10 emu/g to 15 emu/g.

18. A MICR toner composition comprising:

a toner particle further comprising:

a crosslinked resin, wherein the crosslinked polyester has a degree of crosslinking of from about 19% to about 49%;

a magnetite in an amount of from about 10% to about 25% by weight of the toner;

a colorant; and a surface additive applied to a surface of the toner particle, wherein the surface additive comprises a negative charging silica, a positive charging silica and a metal oxide;

further wherein the toner has a magnetic retentivity of from 5 emu/gram to 15 emu/gram, a coercivity of from about 450 Oe to about 550 Oe, and a magnetic saturation of from 10 emu/g to 20 emu/g.

* * * * *